United States Patent [19]

Ogawa

[11] Patent Number: 4,869,186

[45] Date of Patent: Sep. 26, 1989

[54] NEEDLE THREAD TENSION CONTROL SYSTEM WITH DIFFERENTIAL CLAMPING

[75] Inventor: Masao Ogawa, Nagoya, Japan

[73] Assignee: Brother Kogyo Kabushiki Kaisha, Aichi, Japan

[21] Appl. No.: 186,139

[22] Filed: Apr. 26, 1988

[30] Foreign Application Priority Data

Apr. 30, 1987 [JP] Japan ..... 62-106564

[51] Int. Cl.[4] ..... D05B 47/04; D05B 49/00

[52] U.S. Cl. ..... 112/255; 112/241

[58] Field of Search ..... 112/250, 255, 253, 254, 112/241

[56] References Cited

U.S. PATENT DOCUMENTS 4,215,641 8/1980 Dobrjansky et al. ..... 112/255 X
4,632,048 12/1986 Matsubara ..... 112/255 X
4,690,083 9/1987 Hara et al. ..... 112/254
4,791,876 12/1988 Sasaki et al. ..... 112/241

FOREIGN PATENT DOCUMENTS 2186893 8/1987 United Kingdom ..... 112/241

*Primary Examiner*—Andrew M. Falik
*Attorney, Agent, or Firm*—Barnes & Thornburg

[57] ABSTRACT

A needle thread tension control system includes a pair of thread clamping members and a driving mechanism for driving the thread clamping members in timed relation with the rotating speed of a arm shaft. A controlling mechanism controls the driving mechanism to effect a disengaging displacement of the thread clamping members to be smaller than an amount of engaging displacement therof for a predetermined angle of rotation of the arm shaft. The controlling mechanism includes a specific cam drive linkage in the driving mechanism to effect the differential displacements of the clamping members.

5 Claims, 8 Drawing Sheets

NEEDLE THREAD TENSION CONTROL SYSTEM WITH DIFFERENTIAL CLAMPING

BACKGROUND OF THE INVENTION

The present invention relates to a needle thread tension control system provided with a pair of thread clamping members for checking and permitting a supply of needle thread in respective predetermined timing. The clamping members are disposed in relationship to the sewing operation in a thread supply path portion between a thread supply spool and a thread guide of a take-up lever along a thread supply path extending from the thread supply spool to an eye of a needle. A mechanism is provided for driving the thread clamping members, for controlling the driving so as to make an amount of disengaging displacement of the thread clamping members during a predetermined or unit angle of an arm shaft in releasing the needle thread smaller than an amount of engaging displacement of the thread clamping members during rotation of unit angle of the arm shaft in clamping the needle thread.

Generally, the take-up lever driven vertically in timed relation with the arm shaft supplies the needle thread toward a bobbin when the take-up lever descends and also tightens needle thread loop made at the eye of the needle and supplementing a predetermined amount of the needle thread from the thread supply spool when the take-up lever ascends.

Within the thread supply path between the thread supply spool and the thread guide of the take-up lever, there is provided generally a thread controller that provides the needle thread with passage resistance to enable tightening of the needle thread loop. This needle thread controller has a pair of thread control discs contacting each other under pressure of a compression spring and exerts a frictional resistance on the thread passing between the pair of thread control discs.

However, in the needle thread controllers of this kind, the needle thread is supplied under interaction of tension that acts on the needle thread following the thread controller and resistive force in the thread controller. Therefore, it is difficult to exactly control the force of tightening the needle thread and supply quantity of the needle thread and it is also difficult to adjust the needle thread condition of stitches in response to thicknesses and types of work fabrics (that is, thickness and type of the needle thread to be selected according to these factors).

Therefore, as disclosed in Japanese Patent Publication (examined) No. 53-41580, in place of the above described spring actuated thread controller, an electrically actuated needle thread passage control device has been proposed which comprises a pair of the thread control discs that contact under pressure of a solenoid actuator, and allows the needle thread to pass at a predetermined timing during a given time period and does not allow the thread to pass during a period except during the above predetermined timing by driving the actuator in timed relation with the arm shaft rotation.

In the needle thread passage control device described in the above publication, it can only control the thread passage in synchronism with the arm shaft rotation speed regardless of thicknesses and types of the work fabrics, that is, regardless of thicknesses of the needle thread. Further, operation speeds when this control device releases or regulates the thread passage are set independent of the arm shaft rotation speed (sewing speed).

Therefore, this control device performs the same tightening of the needle thread and supplies the same quantity of the needle thread regardless of a thick or a thin thread and can not tighten the needle thread so as to generate a tension corresponding to the thread thickness. This results in unstable thread tightening.

Further, because a supply amount of the needle thread varies slightly as the arm shaft rotation speed varies, the thread tightening varies according to the sewing speed.

To solve these problems, the applicant of the present invention proposed previously an automatic needle thread supply control system for a sewing machine (Refer to application Ser. No. 07/016,332 U.S. Pat. No. 4,791,876). This automatic needle thread supply control system comprises a take-up lever formed with an upper half portion of a swing lever driven by the arm shaft, a take-up lever driving mechanism for driving the swing lever so that the take-up lever is held at the uppermost position from a time when the arm shaft rotated by approximately 40 degrees after the needle bar arrives at its uppermost position to a time when the eye of the needle reaches the upper surface of a throat plate, and a thread passage control device installed in the thread supply path portion between the thread supply spool and the thread guide of the take-up lever along the thread supply path from the thread supply spool to the eye of the needle for checking and permitting the needle thread in timed relation with the rotation of the arm shaft.

The above described thread passage control device comprises a thread guide plate fixed on the machine frame and a clamping wheel as a pair of thread clamping members, and comprises driving means for driving the clamping wheel toward and away from the thread guide plate by means of a rotating cam on the arm shaft through a link mechanism in timed relation with the rotation of the arm shaft.

The thread passage control means is controlled so as to clamp the needle thread with the clamping wheel during tightening of the needle thread when the take-up lever ascends to its uppermost position, and to supply the needle thread of a required (consumed) amount by releasing the clamping wheel from the thread guide plate before the completion of fabric feed motion after tightening of the needle thread, and then to clamp the needle thread with the clamping wheel before the eye of the needle arrives at the throat plate.

In the thread passage control means above-described, since the releasing timing delays in accordance with increase in the thickness of the needle thread when releasing the clamping wheel, the needle thread is tightened with a tightening force corresponding to the thickness of the needle thread, and since the clamping timing is advanced in accordance with increase in the thickness of the needle thread when clamping the needle thread with holding the take-up lever at its uppermost position, a supplying amount of the needle thread decreases and thus the tightening force increases in accordance with increase in the thickness of the needle thread.

As is described above, the tightening force is controlled in accordance with the thickness of the needle thread, both in releasing control and clamping control.

In the automatic needle thread control system, releasing and clamping characteristics are determined with an elliptic locus of an elliptic cam groove formed in the rotating cam on the arm shaft. Therefore, a timing when the clamping wheel separates to a maximum extent from the thread guide plate is in the middle of a releasing timing of releasing the thread and a clamping timing of clamping the thread, and releasing characteristics and clamping characteristics are symmetrical with each other. As a result, disengaging displacement of the clamping wheel during rotation of a predetermined unit angle of the arm shaft in releasing the needle thread is comparatively large, whereby it is difficult to make a high sensitivity of releasing timing varying in accordance with a variation of the thickness of the thread.

Furthermore, since the thread tightening force is controlled at two stages of releasing control and clamping control in accordance with the thread thickness, too strong thread tightening force causes snapping of the needle thread and damaging of the needle.

SUMMARY OF THE INVENTION

The principal object of the present invention is to propose a needle thread tension control system for a sewing machine which controls the tightening tension of the needle thread so as to vary with high sensitivity in accordance with the thread thickness and makes it possible to form stitches with stable tightening force.

The foregoing object is attained according to the principle of the present invention.

The present invention relates to a needle thread tension control system for use in a sewing machine having an arm shaft driven by a motor, a needle thread supply source, an endwise reciprocatory needle with an eye, a take-up member movable between a maximum thread slack position and a maximum thread take-up position, a needle thread supply path extending from the needle thread supply source through the take-up member to the eye of the needle, and a pair of thread clamping members movable toward and away from each other for checking and permitting the supply of the needle thread from the needle thread supply source toward the take-up member; the needle thread tension control system comprising; driving means for driving at least either of the thread clamping members so that the thread clamping members move toward and away relatively to each other in timed relation with the rotation of the arm shaft, and controlling means for controlling the driving means so as to make an amount of disengaging displacement of the thread clamping members during rotation of a unit angle of the arm shaft in releasing the needle thread smaller than an amount of engaging displacement of the thread clamping members during rotation of the unit angle of the arm shaft in the clamping said needle thread.

In the needle thread tension control system according to the present invention, by means of driving at least either of the thread clamping members in timed relation with the rotation of the arm shaft, the supply of the needle thread is checked when the thread clamping members move toward relatively toward each other, and the supply of the needle thread is permitted when the thread clamping members move away relatively to each other.

By the controlling means, an amount of disengaging displacement of the thread clamping members during rotation of a predetermined unit angle of the arm shaft is controlled to be smaller than an amount of engaging displacement of the thread clamping members during rotation of the unit angle of the arm shaft, whereby a sensitivity of variation in release timing for releasing the needle thread in accordance with a variation in the thread thickness is improved and simultaneously a sensitivity of variation in clamping timing for clamping the needle thread in accordance with a variation in the thread thickness is deteriorated.

Accordingly, in accordance with the increase in the thread thickness, the releasing timing delays with high sensitivity and the clamping timing scarcely varies. Thus, a thick thread is released at later timing than a thin thread, and the needle thread is tightened with a stable tension corresponding to the thread thickness. Furthermore, clamping timing is settled at almost constant timing regardless of thread thickness because of low sensitivity to the variation in thread thickness, whereby the thread thickness scarcely influences the tightening tension in clamping. This enables prevention of extreme tightening tension when stitching a thick fabric with a thick thread.

As described hereinbefore, the needle thread tightening tension can be controlled to be a proper one corresponding to the thread thickness, and the thread condition in stitches can be stabilized regardless of the thread thickness.

DESCRIPTION OF THE DRAWINGS

Figures illustrate embodiments of the present invention.

DESCRIPTION OF THE PREFERRED EMBODIMENTS

Preferred embodiments of the present invention will be described hereinafter with reference to the accompanying drawings.

Figure 1:
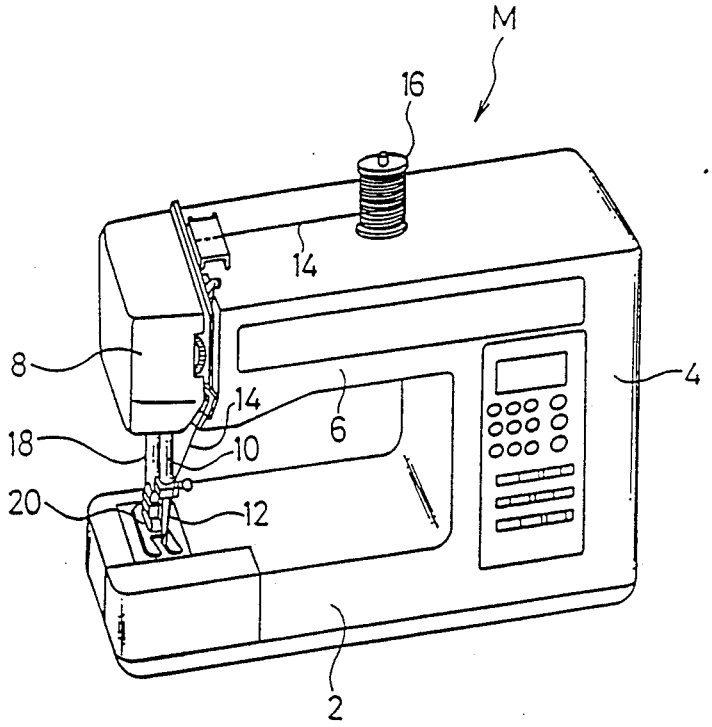
FIG. 1 is a schematic perspective view of a sewing machine.

FIG. 1 illustrates an electronic lock stitch sewing machine M incorporating an embodiment of the present invention. Illustrated in FIG. 1 are a bed 2, a standard 4 extending upright from the right end of the bed 2, and an arm 6 horizontally extending from the upper end of the standard 4, overhanging the bed 2 and having a head 8 at the left end thereof. A needle bar 10 and a presser bar 18 are provided in the head 8. A needle 12 is attached to the lower end of the needle bar 10. The needle bar 10 is driven for vertical reciprocatory motion and for lateral jogging motion by the arm shaft 28 of the sewing machine. A presser foot 20 is attached to the lower end of the presser bar 18. The presser bar 18 is raised or lowered by means of an operating member (not shown).

A throat plate 22 is provided on the bed 2, and a feed dog 23 is provided in the bed 2 so as to be moved upward through slots formed in the throat plate 22 by a feed mechanism. Predetermined stitches are formed in a work fabric through the cooperative operation of the needle bar 10 and the feed mechanism including the feed dog 23. Since the feed mechanism is of an ordinary known constitution, the description thereof will be omitted.

Figure 2:
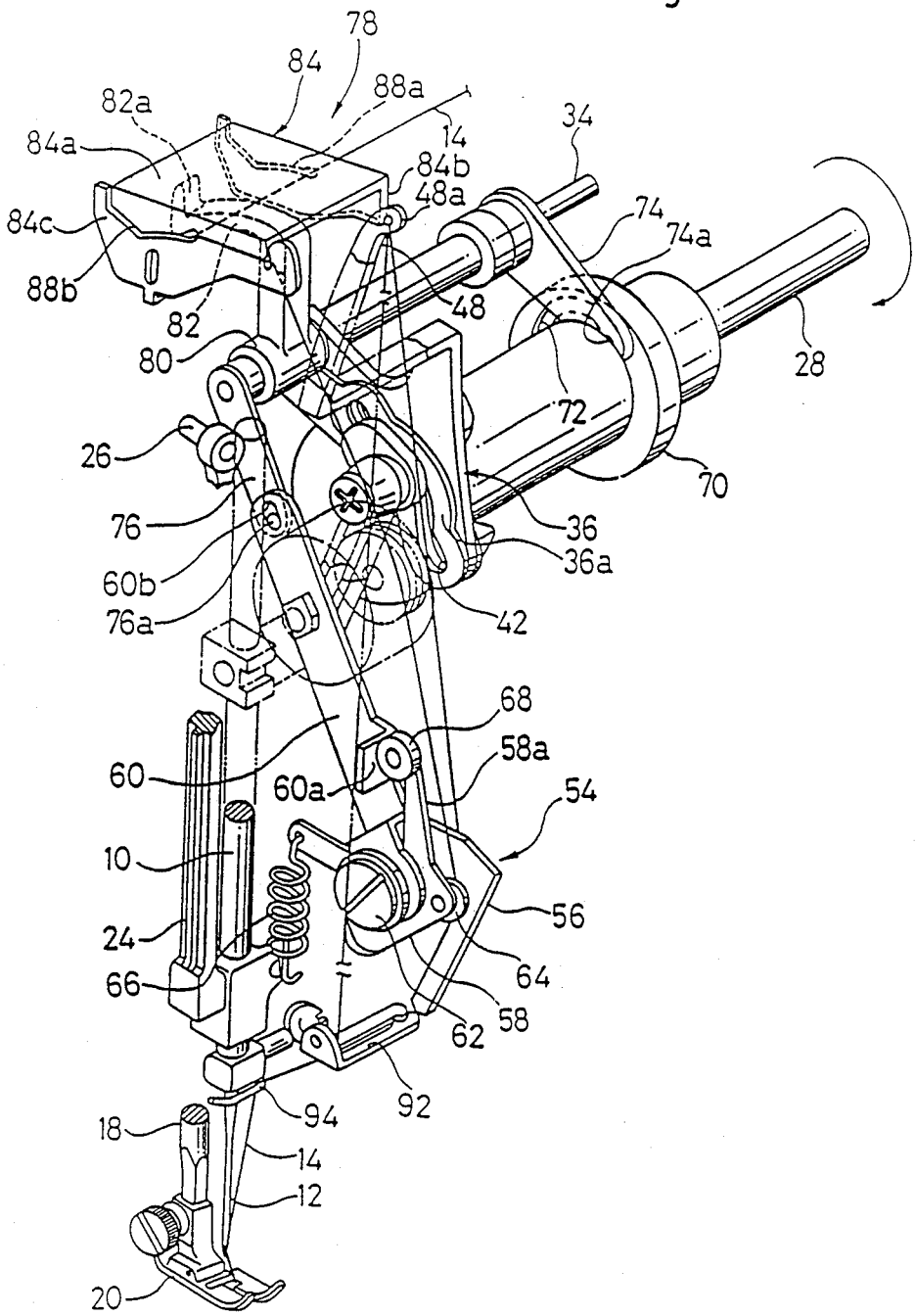
FIG. 2 is a perspective view of the essential portion of the internal mechanism built in the arm and head of the sewing machine.
Figure 3:
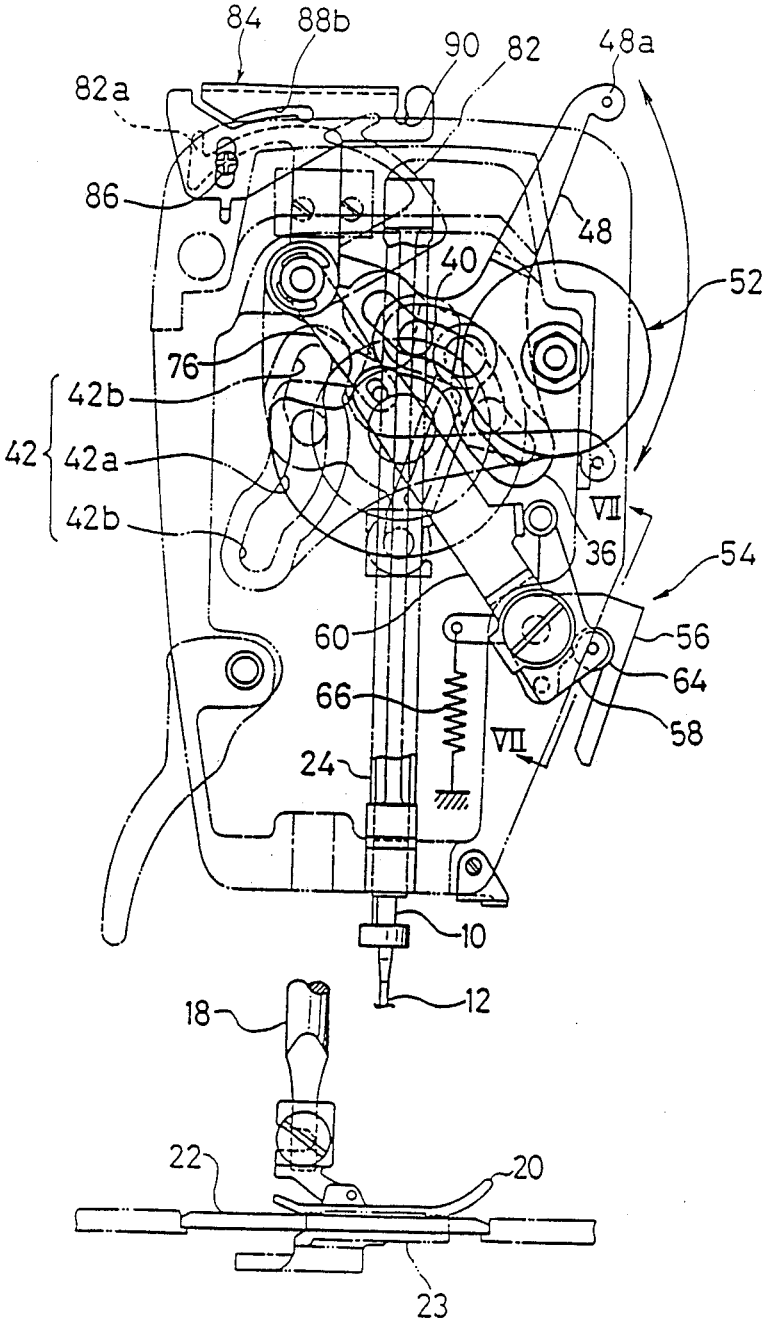
FIG. 3 is a side elevation of the internal mechanism.
Figure 4:
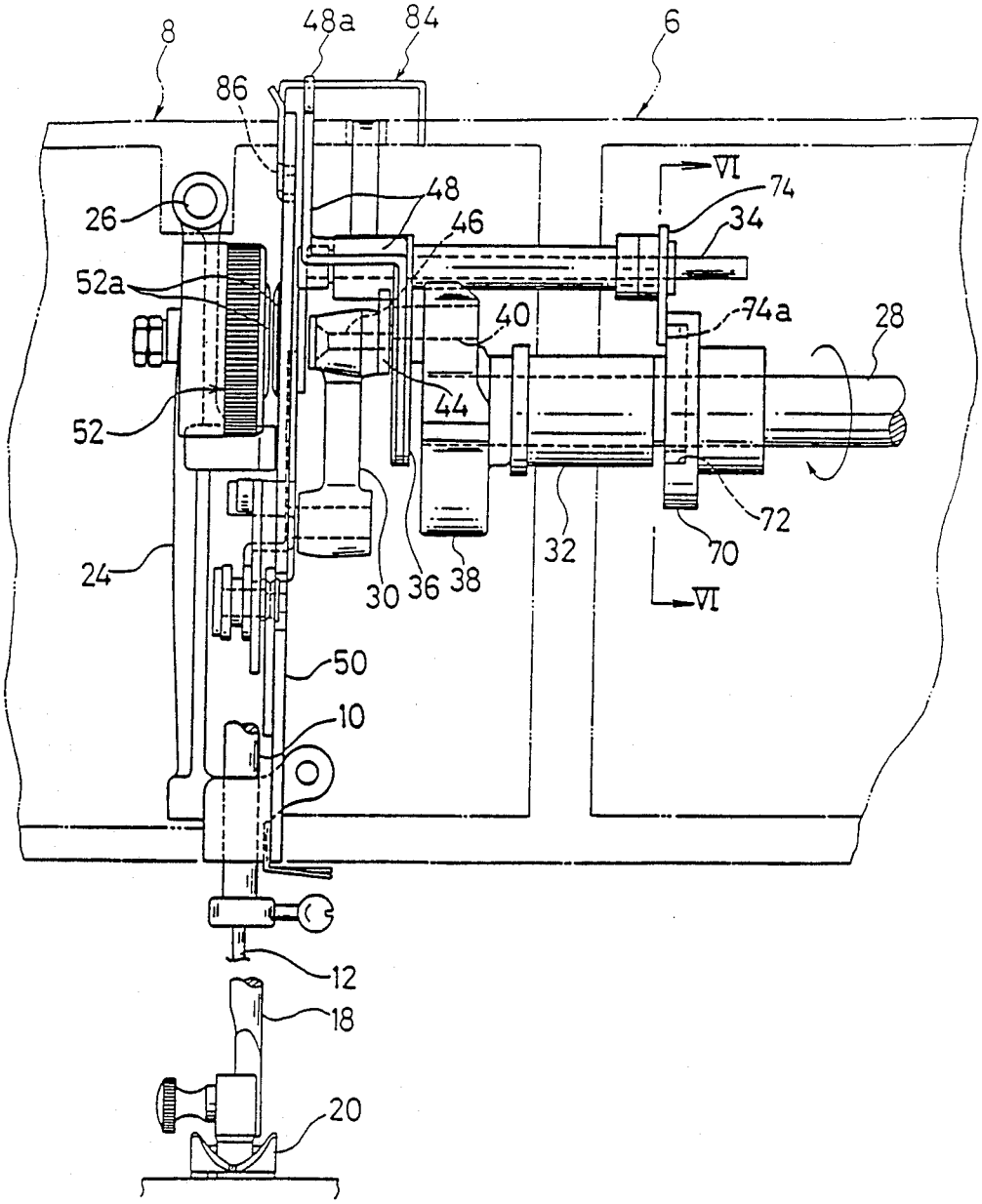
FIG. 4 is a front elevation of the internal mechanism.

FIGS. 2 to 4 illustrate internal mechanisms disposed within the head 8 and part of the arm 6 near the head 8 of the sewing machine M.

As illustrated in FIGS. 2 to 4, the needle 12 is attached to the lower end of the needle bar 10, while the needle bar 10 is supported vertically movably by a needle bar support 24. The needle bar support 24 is supported pivotally at the upper end thereof with a pin 26 on the frame so as to jog laterally. The needle bar 10 is driven by the arm shaft 28 and a needle bar crank 30 secured to the free end of the arm shaft 28 for vertical motion relative to the needle bar support 24.

The presser foot 20 is attached detachably to the lower end of the presser bar 18, while the presser bar 18 is secured to the frame by a mechanism (not shown) so as to be moved between an upper position and a lower position. When the presser bar 18 is moved to the lower position, the presser foot 20 presses a work fabric against the throat plate 22.

A take-up lever mechanism will be described hereinafter with reference to FIGS. 2 to 4.

The arm shaft 28 is supported rotatably in a bearing bush 32 or the like on the frame. An auxiliary shaft 34 is disposed above and behind the arm shaft 28 so as to extend in parallel to the same. The auxiliary shaft 34 is journaled on the frame. A swing lever 36 is supported swingably at one end thereof on the auxiliary shaft 34. The swing lever 36 extends from the auxiliary shaft 34 to the left side of a take-up lever crank 38 fixedly mounted on the arm shaft 28. The crank pin 40 of the take-up lever crank 38 extends through a cam slot 42 formed in the swing lever 36. A connecting plate 44 is fixed to the left end of the crank pin 40. The needle bar crank 30 is connected rotatably to the connecting plate 44 with a pin 46 extending leftward from the connecting plate 44. The needle bar crank 30 is connected at the lower end thereof to the middle part of the needle bar 10.

The upper part of the swing lever 36 is bent in a zigzag shape to form a take-up lever 48 (take-up member) which extends upward. A thread guide hole **48*a* is formed at the free end of the take-up lever 48**.

As illustrated in FIGS. 2 and 3, the slot cam 42 of the swing lever 36 consists of a circular arc section **42*a* having a radius of curvature coinciding with the radius of the circular locus of the crank pin 40 and permitting the rotation of the crank pin 40 through an angle of approximately 74° in a range about the uppermost position of the crank pin 40, and short straight sections 42*b* extending from the opposite ends of the circular arc section 42*a*, respectively. The cam slot 42 is reinforced along the periphery thereof with a reinforcement 36*a***.

When the take-up lever crank 38 and the crankpin 40 are turned around the arm shaft 28 with the crankpin 40 engaging the cam slot 42 of the swing lever 36, the swing lever 36 is driven for reciprocatory swing motion about the auxiliary shaft 34 between an uppermost position indicated by continuous lines (FIG. 3) and a lowermost position indicated by imaginary lines (FIG. 3) by the crankpin 40, while the needle bar 10 is driven for vertical reciprocatory motion through the needle bar crank 30 and the crankpin 40 by the arm shaft 28 in phase with the arm shaft 28.

Figure 5:
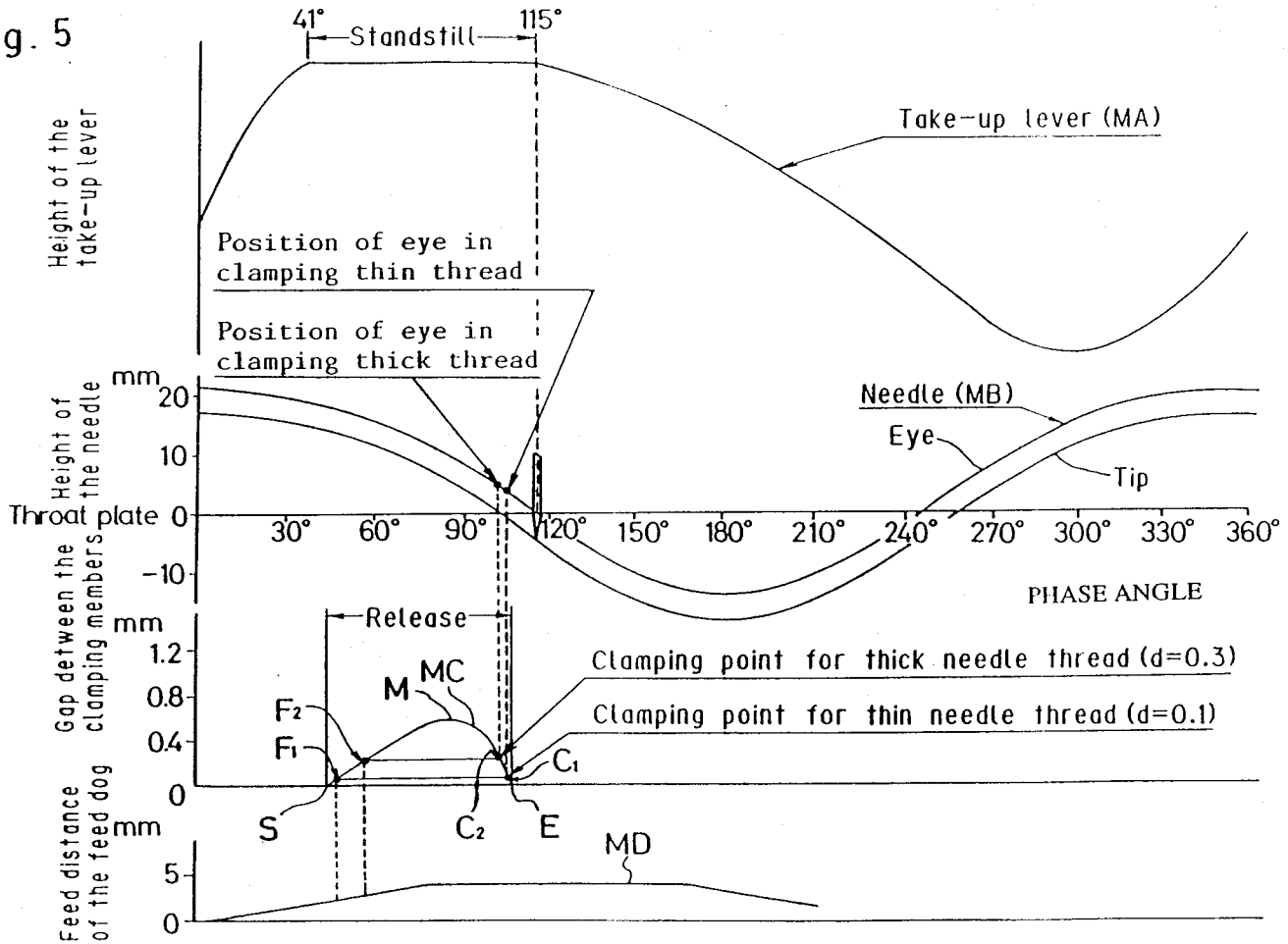
FIG. 5 is a time chart showing the respective motions of the mechanisms of the sewing machine.

Since the cam slot 42 of the swing lever 36 has the circular arc section **42*a*, the take-up lever 48, the needle 12 attached to the lower end of the needle bar 10 and the feed dog 23 of the feed mechanism perform motions represented by motion curves MA, MB and MD as functions as the phase angle of the arm shaft 28 as a parameter in FIG. 5, respectively. In addition, the phase angle is 0 degree when the needle bar 10** is at its uppermost position.

The take-up lever 48 is held a the uppermost position from a time after the arm shaft 28 has turned through an angle of approximately 40° from the start of the feed motion to a time when the eye of the needle 12 arrives at the upper surface of the throat plate 22. Accordingly, the take-up lever 48 is held at the upper most position substantially during the feed motion except the initial stage of the feed motion. The swing lever 36 may be designed so that the take-up lever 48 is held at the upper most position from the start of the feed motion. In either case, the swing lever 36 is comparatively simple in construction and is able to operate smoothly and silently.

A needle thread supply control mechanism including a needle thread tension control system will be described hereinafter with reference to FIGS. 2 to 7.

A plate member 50 forming part of the frame is disposed near and on the lefthand side of the needle bar crank 30 disposed on the lefthand side of the arm shaft 28. The plate member 50 extends at right angles to the arm shaft 28. As illustrated in FIGS. 2 and 3, a pre-tension device 52 for exerting a tension to the needle thread 14 is provided, when necessary, on the left side of the plate member 50 slightly before the arm shaft 28.

The pre-tension device 52 has a pair of tension discs **52*a* which exert a tension to the needle thread passing therebetween. The tension of the needle thread is adjusted by regulating spring force applied to the tension discs 52*a* by operating a dial. The pre-tension device 52** may be omitted.

A thread supply control device 54 which clamps or releases the needle thread 14 in synchronism with the rotation of the arm shaft 28 is provided in a thread path portion between a thread supply spool 16 and the thread guide hole **48*a* of the take-up lever 48 along the thread path extending from the thread supply spool 16 to the eye of the needle 12 via the guide hole 48*a*. The thread supply control device 54 comprises a thread guide plate 56, and a swing lever 58 provided with a thread clamping wheel 64. The thread guide plate 56 (thread clamping member) is secured to the left side of the plate member 50 at a position below the pre-tension device 52. The swing lever 58 is disposed adjacent to the left side of the thread guide plate 56 and is pivotally attached to the plate member 50 with a hinge screw 62. A link plate 60 also is pivotally attached at the lower end thereof to the plate member 50 with the hinge screw 62. The thread clamping wheel 64 (thread clamping member) held on the swing lever 58 engages the thread clamping edge 56*a* of the thread guide plate 56 to clamp the needle thread 14 between the thread clamping edge 56*a* and the thread clamping wheel 64. The swing lever 58 is biased resiliently by a spring 66 having one end connected to the frame and the other end connected to the swing lever 58 so that the thread clamping wheel 64 is pressed against the thread clamping edge 56***a*. A contact wheel 68 attached to the upper end of the arm 58*a* of the swing lever 58 is in contact with the front surface of a contact lug 60*a* formed near the lower end of the link plate 60.

Figure 7:
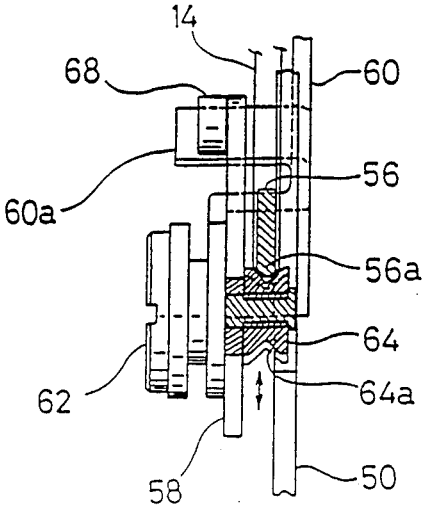
FIG. 7 is a sectional view taken on line VII—VII in FIG. 3.

As illustrated in FIGS. 2, 3 and 7, an annular V-shaped groove 64*a* is formed in the circumference of the thread clamping wheel 64, while the thread clamping edge 56*a* of the thread guide plate 56 is formed in a U-shaped curve opening downward in a side view and in a U-shaped in section. The V-shaped groove 64*a* of the thread clamping wheel 64 and the U-shaped thread clamping edge 56*a* of the thread guide plate 56 engage to clamp the needle thread 14 therebetween.

After passing the pre-tension device 52 the needle thread 14 is turned by the U-shaped thread clamping edge 56*a* of the thread guide plate 56, and is guided via the thread guide hole 48*a* of the take-up lever 48 to the needle 12. When the thread clamping edge 56*a* and the V-shaped groove 64*a* are engaged, the needle thread 14 is clamped firmly between the thread clamping edge 56*a* and the V-shaped groove 64*a* at two points. Particularly, since the thread clamping wheel 64 is moved in parallel to a plane including the thread supply path returned at the thread clamping edge 56*a* and the thread clamping wheel 64 clamps the needle thread 14 across the same, a very high clamping pressure is applied to the needle thread 14. That is, if the thread clamping wheel 64 is pressed with a small force against the thread clamping edge 56*a*, the needle thread 14 can firmly be clamped.

Figure 6:
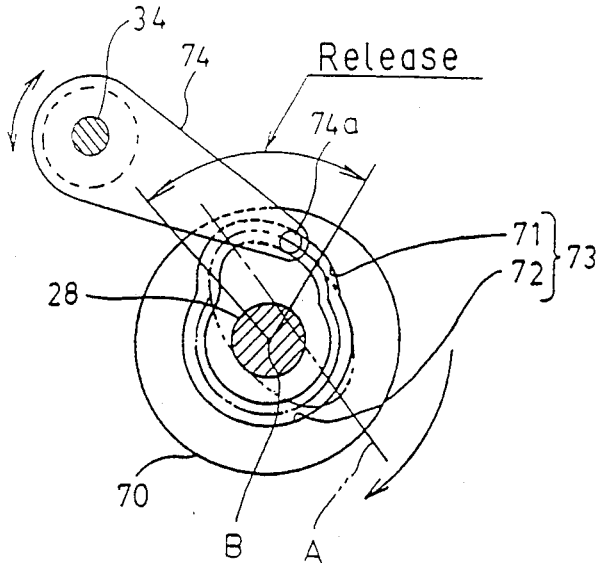
FIG. 6 is a sectional view taken on line VI—VI in FIG. 4.

In order to drive up and down the thread clamping wheel 64 on the swing lever 58 in timed relation with the rotation of the arm shaft 28 with an operating speed proportional to the rotating speed of the arm shaft 28, and to carry out releasing and clamping of the needle thread 14 in respective predetermined timing, a rotary cam 70 is fixed on the arm shaft 28 at the position corresponding to the right end of the auxiliary shaft 34, and as illustrated in FIG. 6 this rotary cam 70 is provided with a continuous cam groove 73 consisting of a partial elliptic cam groove 71 and a partial circular cam groove 72, and above-described elliptic cam groove 71 has its major axis apart from the center point B of the arm shaft 28. A contact pin 74*a* on lower end of the first lever 74 fixed on the auxiliary shaft 34 at upper end thereof is engaged in the cam groove 73.

On the other hand, a second arm 76 is fixedly mounted to the auxiliary shaft 34 at the left end of the same. A pin 76*a* attached to the free end of the second arm 76 is received in a slot 60*b* formed in the upper end of the link plate 60 to interconnect the second arm 76 and the link plate 60

In the above-described needle thread supply control mechanism, the rotary cam 70 is rotated with the arm shaft 28 to swing the first arm 74 by the contact 74*a* and the cam groove 73, and the second arm 76 is swung through the auxiliary shaft 34, and thus the link plate 60 is driven swingingly around the hinge screw 62.

When the contact wheel 68 is pushed forward by the contact lug 60*a* of the link plate 60 as the link plate 60 is driven by the second arm 76, the swing lever 58 is turned against the resilient force of the spring 66, so that the thread clamping wheel 64 is separated from the thread clamping edge 56*a* of the thread guide plate 56 to release the needle thread 14. When the contact lug 60*a* of the link plate 60 is moved backward, the swing lever 58 is turned in the opposite direction by the spring 66, so that the thread clamping wheel 64 engages the thread clamping edge 56*a* to clamp the needle thread 14. Thus, the needle thread 14 is clamped and released alternately at predetermined phase angles, respectively. The needle thread clamping and releasing motion is represented by a motion curve MC in FIG. 5.

As is apparent from FIG. 5, during the upward movement of the take-up lever 48 from the lowermost position to the uppermost position for tightening the needle thread 14, the needle thread 14 is clamped between the thread guide plate 56 and the thread clamping wheel 64 so that the needle thread 14 is reliably tightened. After the needle thread 14 has completely been tightened, the swing lever 58 is driven in phase with the feed motion to release and supply the needle thread 14. While the needle thread 14 is thus released free, the feed motion and the needle jogging motion are accomplished, and then the needle thread 14 is clamped again before the needle 12 arrives at the throat plate 22. While the needle thread 14 is clamped, the stitching motion is carried out to form a needle thread loop by the shuttle. Accordingly, the needle thread 14 of an amount necessary for feeding the work fabric and for jogging the needle 12 is reliably supplied, while the needle thread 14 is not supplied uselessly while a loop of the needle thread 14 is formed, because the needle thread 14 is clamped during the loop forming period.

In clamping characteristics determined according to the shape of the cam groove 73 as illustrated with a curved line MC in FIG. 5, the releasing displacement increases gradually and almost linearly from a release start point S where the thread clamping wheel 64 starts to separate from the thread clamping edge 56*a* to a maximum separating point M where the thread clamping wheel 64 separates to a maximum extent from the thread guide plate 56, and the releasing displacement decreases along a curved line from the maximum separate point M to a release end point E where the thread clamping wheel 64 contacts the thread guide plate 56, and the maximum separating point M is located near the release end point E.

That is, an amount of disengaging displacement of the thread clamping wheel 64 from the thread guide plate 56 during rotation of a predetermined unit angle of the arm shaft 28 in releasing the needle thread 14, is smaller than an amount of engaging displacement of the thread clamping wheel 64 with the thread guide plate 56 during the rotation of a corresponding predetermined unit angle of the arm shaft 28. Accordingly, releasing timing delays with high sensitivity accordance with a minute variation in the thread thickness, are provided and clamping timing is kept almost constant even if the variation in the thread thickness is comparatively large.

As a result, when the thickness of the needle thread 14 is small, the needle thread 14 is released and is clamped at a point $F_1$ and at a point $C_1$, respectively. When the thickness of the needle thread 14 is large, the needle thread, 14 is released at a point $F_2$ delayed substantially from the point $F_1$, and is clamped at the point $C_2$ just before the point $C_2$. Accordingly, thin needle threads 14 are tightened properly with a low tension, and thick needle threads 14 are tightened properly with a high tension before releasing.

Furthermore, since thin and thick needle threads are clamped at almost constant timing regardless of the thread thickness, the increase in the tightening tension is scarcely caused by the difference in clamping timing, and snapping of the needle thread 14 and/or damage of the needle 12 can be prevented even when sewing a thick fabric with a thick needle thread.

In accordance with the cam groove 73 of the rotary cam 70, both of the swinging speeds of the first lever 74 in moving upwards and downwards are proportional to the rotating speed of the arm shaft 28, whereby the thread clamping wheel 64 moves toward or away from the thread clamping edge 56*a* at a speed proportional to the rotating speed of the arm shaft 28.

Thus, a substantially fixed amount of the needle thread 14 is supplied in every stitching cycle regardless of the rotating speed of the arm shaft 28, and hence the tension of the needle thread in forming stitches is not affected by the stitching speed.

A needle thread supply mechanism 78 which draws out the needle thread 14 from the thread supply spool 16 by a predetermined amount and stores the same while the take-up lever 48 is moved downward and the needle thread 14 is clamped between the needle thread clamping wheel 64 and the needle thread guide plate 56 will be described hereinafter with reference to FIGS. 2 to 4.

A sleeve 80 is fitted rotatably on the auxiliary shaft 34 near a position where the auxiliary shaft 34 supports the swing lever 36 at one end, and the end of the swing lever 36 on the auxiliary shaft 34 is fixed to the sleeve 80. An L-shaped arm 82 having a thread catching hook 82*a* at the free end thereof is fixed to the sleeve 80. A thread guide member 84 substantially of a U-shape in front view is disposed on top of the left end of the arm 6 of the sewing machine M. The thread guide member 84 has a top wall 84*a*, a first guide wall 84*b* and a second guide wall 84*c*. The first guide wall 84*b* and the second guide wall 84*c* extend vertically downward from the opposite sides of the top guide wall 84*a*, respectively. The second guide wall 84*c* of the thread guide member 84 is fixed to the upper end of the plate member 50 with a screw 86. The thread guide member 84 is disposed near and above the L-shaped arm 82. The first guide wall 84*b* and the second guide wall 84*c* are disposed opposite to each other with a predetermined distance therebetween. A first guide slit 88*a* and a second guide slit 88*b* are formed laterally opposite to each other in the first guide wall 84*b* and the second guide wall 84*c*, respectively. The respective rear ends of the first guide slit 88*a* and the second guide slit 88*b* are open to receive the needle thread 14 therein. A third guide slit 90 is formed in the upper part of the front end of the second guide wall 84*c*.

The needle thread 14 pulled out from the thread supply spool 16 is extended sequentially through the first guide slit 88*a*, the second guide slit 88*b*, along the left side of the second guide wall 84*c*, via the third guide slit 90, the pre-tension device 52, the thread clamping edge 56*a* of the thread guide plate 56, where the needle thread 14 is returned upward, and then further through the thread guide hole 48*a* of the take-up lever 48, and thread guides 92 and 94 to the eye of the needle 12.

Both the L-shaped arm 82 and the swing lever 36 are fixed to the sleeve 80, and hence the L-shaped arm 82 and the swing lever 36 are driven for swing motion by the take-up lever crank 38 in phase with the rotation of the arm shaft 28. As illustrated in FIG. 3, while the take-up lever 48 is held at the uppermost position as indicated by continuous lines, the L-shaped arm 82 is located, as indicated by dotted lines, behind the needle thread 14 passing the respective front ends of the first guide slit 88*a* and the second guide slit 88*b*. On the other hand, when the take-up lever 48 is moved downward to the lowermost position as indicated by imaginary lines, the swing lever 36 swings on the auxiliary shaft 34 and the L-shaped arm 82 swings forward as indicated by imaginary lines on the auxiliary shaft 34, so that the thread catching hook 82*a* is moved forward and engages the needle thread 14 extending between the respective front ends of the first guide slit 88*a* and the second guide slit 88*b*, and thereby the needle thread 14 is pulled by the thread catching hook 82*a* by a predetermined distance. Since the needle thread 14 is clamped between the thread clamping wheel 64 and the thread guide plate 56 while the needle thread 14 is pulled by the thread catching hook 82*a*, a predetermined amount of the needle thread is reliably pulled out from the thread supply spool 16.

Thus, while the take-up lever 48 is located at the lowermost position, the needle thread 14 is pulled out from the thread supply spool 16 by the L-shaped arm 82 of the needle thread supply mechanism 78, so that the needle thread 14 between the thread supply spool 16 and the thread clamping edge of the thread guide plate 56 is slackened. After the needle thread 14 has thus been slackened, the take-up lever 48 is moved upward to tighten the needle thread 14, then the needle thread 14 is released from the restraint of the thread guide plate 56 and the thread clamping wheel 64, and then the needle thread 14 of a necessary amount is supplied via the take-up lever 48 to the needle 12 as the feed dog 23 performs the feed motion and the needle 12 is jogged.

Although the feed motion of the feed dog 23 is started before the needle thread 14 is released, the amount of the needle thread 14 required for such a mode of feed motion is supplemented by the elastic extension of the needle thread 14, and the needle thread 14 is recovered from the elastic extension as the same is supplied after being released.

Thus, the phases of the needle thread clamping and releasing operations are controlled automatically according to the thickness of the needle thread 14, and the needle thread 14 of a necessary amount dependent on the feed stroke and the needle jogging stroke is reliably supplied for every stitching cycle. Accordingly, an optimum tension according to the thickness of the needle thread 14 is exerted to the needle thread 14.

Figure 8:
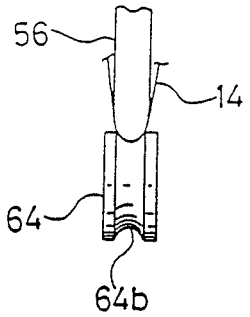
FIG. 8–11 are schematic illustrations equivalent to FIG. 7, showing modifications of the thread clamping members.
Figure 9:
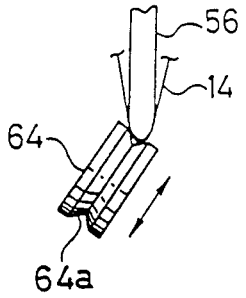
Figure 10:
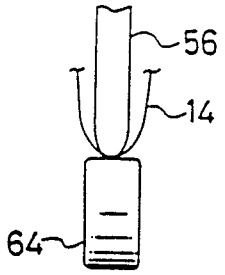
Figure 11:
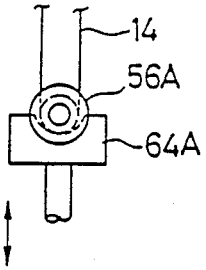

In the thread supply control device 54, a U-shaped groove 64*b* may be formed in the circumference of the thread clamping wheel 64, as illustrated in FIG. 8, the thread clamping wheel 64 may be moved obliquely relative to the thread guide plate 56 as illustrated in FIG. 9, or the needle clamping wheel 64 may have a cylindrical circumference as illustrated in FIG. 10. Furthermore, although not shown, a member secured to the swing lever 58 may be employed instead of the thread clamping wheel 64. Still further, it is also possible to employ a grooved free wheel 56A instead of the thread clamping edge 56*a*. When the free wheel 56A is employed, the needle thread 14 is wound around the half of the circumference of the free wheel 56A, and a clamping member 64A substituting the thread clamping wheel 64 is brought into point-contact with the circumference of the free wheel 56A to clamp the needle thread as illustrated in FIG. 11.

Figure 12:
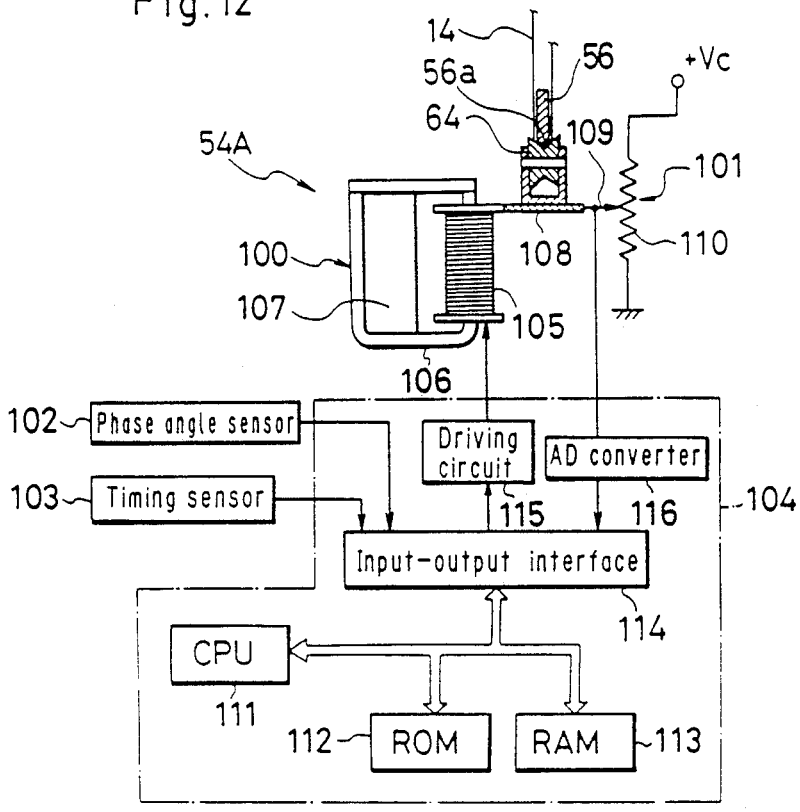
FIG. 12 is a block diagram showing the electrical construction of a modified embodiment.

A modification of the needle thread supply control mechanism will be described hereinafter with reference to FIG. 12 and FIG. 13.

The thread supply control device 54A comprises the thread clamping wheel 64, a linear actuator 100 for driving the thread clamping wheel 64, a displacement sensor 101 for sensing the displacement of the thread clamping wheel 64, a phase angle sensor 102 for sensing the phase angle of the arm shaft 28, a timing sensor 103, and a control unit 104.

The linear actuator 100 comprises a moving coil 105 connected to the thread clamping wheel 64, a metallic frame 106 vertically movably retaining the moving coil 105 and forming a magnetic path, and a permanent magnet 107 forming a uniform magnetic field around the moving coil 105. The vertical position of the moving coil 105 is determined according to the intensity of current supplied to the moving coil 105.

The displacement sensor 101 is a potentiometer comprising a contact 109 connected to the thread clamping wheel supporting member 108 of the moving coil 105, and electric resistor 110 connected to a reference voltage line.

The phase angle sensor 102 comprises, for example, a disc having a plurality of slits formed along the circumference thereof at regular angular intervals and fixed to the arm shaft 28, and a photoelectric detector comprising a light emitting element and a light receiving element for detecting the slits.

The timing sensor 103 is a limit switch or a contactless switch which detects the arrival of the needle bar 10 at the upper most position.

The control unit 104 comprises a central processing unit (hereinafter abbreviated to "CPU") 111, a read-only memory (ROM) 112, a random access memory (RAM) 113, an input-output interface 114, a driving circuit 115 which receives control signals through the input-output interface 114 from the CPU 111 and supplies a driving current corresponding to the input signal to the moving coil 105, and an AD converter 116 which converts an analog detection signal of the displacement sensor 101 into a digital signal corresponding to the analog detection signal and gives the same to the input-output interface 114. The detection signals of the phase angle sensor 102 and the timing sensor 103 are given through the input-output interface 114 to the CPU 111. The input-output interface 114, the ROM 112 and the RAM 113 are connected through an address bus and a data bus to the CPU 111.

The ROM 112 pre-stores a control program or controlling the linear actuator 100 in accordance with a timing signal $S_1$ given by the timing sensor 103, a phase angle signal $S_2$ given by the phase angle sensor 102 and a displacement signal given by the displacement sensor 101 to regulate the gap between the thread clamping wheel 64 and the thread clamping edge **56*a* of the thread guide plate 56**.

Since the mode of controlling the linear actuator 100 is comparatively simple, the same will be described characteristically hereinafter.

Figure 13:
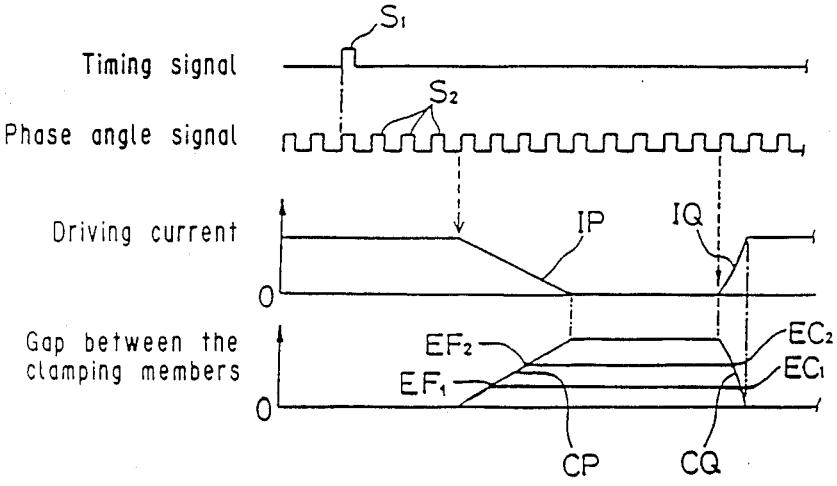
FIG. 13 is a time chart showing the timing signal, the phase signal, the solenoid driving current and the gap of the thread path.

Referring to FIG. 13, a predetermined current is supplied to the moving coil 105 until a predetermined number of phase angle signals $S_2$ are given to the CPU 111 after a timing signal $S_1$ has been given to the CPU 111, and thereby the thread clamping wheel 64 is held in contact with the thread clamping edge **56*a* to clamp the needle thread 14** therebetween.

Upon the reception of the predetermined number of phase angle signals $S_2$, the CPU 111 controls the driving circuit 115 so as to reduce the driving current at a rate corresponding to the rotating speed of the arm shaft 28 as represented by a curve IP; consequently, the moving coil 105 is lowered gradually to increase the gap between the thread clamping wheel 64 and the thread clamping edge **56*a*** as represented by a curve CP.

The rotating speed of the arm shaft 28 is determined through computation on the basis of the phase angle signals $S_2$. Various CP curves for various rotating speeds are stored as a memory map in the ROM 112. The magnitude of the driving current is controlled momently through feedback control on the basis of the displacement signals given by the displacement sensor 101 in a mode as represented by the curve IP.

Similarly to the manner of control in the foregoing embodiments, the curves CP corresponding to the rotating speed of the arm shaft 28 are stored in the memory map of the ROM 112 to regulate the rate of increasing the gap between the thread clamping wheel 64 and the thread clamping edge **56*a* in proportion to the rotating speed of the arm shaft 28**.

The magnitude of the driving current is controlled in the same manner to decrease the gap between the thread clamping wheel 64 and the thread clamping edge **56*a* in clamping the needle thread 14. The timing of driving the moving coil 105 is determined by counting the phase angle signals $S_2$, and then the magnitude of the driving current supplied to the moving coil 105 is regulated through feedback control on the basis of the displacement signals according to a curve IQ so that the gap is decreased along a curve CQ stored in the memory map of the ROM 112**.

Similarly to the curve MC in FIG. 5 for the aforementioned embodiment, the increasing displacement of the thread passage gap during rotation of a corresponding unit angle of rotation of the arm shaft 28 is smaller than the decreasing displacement of the thread passage gap during rotation of unit angle of the am shaft 28. Thus, a thin needle thread in released at a point EF, and is clamped at a point EC, and a thick needle thread is released at a point $EF_2$ and is clamped at a point $EC_2$.

The linear actuator 100 employed in this embodiment may be substituted by a stepping motor or the like.

What is claimed is:

1. In a sewing machine having an arm shaft driven by a motor, a needle thread supply source, an endwise reciprocatory needle with an eye, a take-up member movable between a maximum thread slack position and a maximum thread take-up position, a needle thread supply path extending from the needle thread supply source through the take-up member to the eye of the needle, and a pair of thread clamping members movable toward and away from each other for clamping and releasing the needle thread from said needle thread supply source toward said take-up member by respective engaging and disengaging displacement of the clamping members;

a needle thread tension control system comprising;

driving means for driving at least either of said thread clamping members so that said thread clamping members move toward and away with respect to each other in timed relationship with the rotation of said arm shaft, and controlling means for controlling said driving means so that a disengaging displacement or opening of said thread clamping members during a predetermined angular rotation of said arm shaft in releasing said needle thread is smaller than an engaging displacement or closing of said thread clamping members during a corresponding predetermined angular rotation of said arm shaft whereby threads of different thicknesses can be accommodated by said thread clamping members.

2. A needle thread tension control system according to claim 1, wherein said controlling means comprises a cam member operatively connected to said arm shaft, and a cam follower engageable with said cam member and operatively connected to one of said thread clamping members.

3. A needle thread tension control system according to claim 2, wherein said cam member is provided with a cam groove formed continuously with a circular cam portion and an elliptic cam portion for controlling the speed of said clamping members.

4. A needle thread tension control system according to claim 1, wherein a pair of said thread clamping members have clamping surfaces which engage in point contact with each other to reliably clamp the needle thread.

5. A needle thread tension control system according to claim 1, wherein said controlling means includes a rotary member operatively connected to said arm shaft, sensor means for generating a pulse signal every predetermined angle of rotation of said rotary member, and wherein said driving means is an electric actuating means for actuating at least one of said thread clamping members in response to said pulse signal.

* * * * *